United States Patent [19]

Boone

[11] 3,978,894

[45] Sept. 7, 1976

[54] ENERGY ABSORBING TEAR-WEBBING

[75] Inventor: Jay D. Boone, Seeley, Calif.

[73] Assignee: The United States of America as represented by the Secretary of the Navy, Washington, D.C.

[22] Filed: Feb. 5, 1973

[21] Appl. No.: 329,502

[52] U.S. Cl. ..... 139/383 R; 139/408

[51] Int. Cl.[2] ..... D03D 25/00; D03D 23/00

[58] Field of Search ..... 139/408–415, 139/391, 384, 383, 397; 244/122 R, 122 B, 110 R; 74/231, 232

[56] References Cited

UNITED STATES PATENTS

| | | | |
|---|---|---|---|
| 1,571,085 | 1/1926 | Brahs | 139/408 X |
| 2,242,128 | 5/1941 | Hornsby | 139/391 UX |
| 2,356,456 | 8/1944 | Garner | 139/397 X |
| 2,794,450 | 6/1957 | Gatzke | 139/411 |
| 2,864,409 | 12/1958 | Richter | 139/408 |
| 2,925,098 | 2/1960 | Frieder et al. | 139/408 |
| 2,983,304 | 5/1961 | Rasero | 74/232 |
| 3,177,904 | 4/1965 | Siverson | 139/409 |
| 3,463,202 | 8/1969 | Wildi et al. | 139/383 |
| 3,612,110 | 10/1971 | Wildi et al. | 139/383 |

FOREIGN PATENTS OR APPLICATIONS

| | | | |
|---|---|---|---|
| 27,154 | 1906 | United Kingdom | 139/409 |
| 907,009 | 9/1962 | United Kingdom | 139/384 R |

*Primary Examiner*—James Kee Chi

*Attorney, Agent, or Firm*—R. S. Sciascia; G. J. Rubens

[57] ABSTRACT

An improved tear webbing is fabricated of two woven straps offering gradually increasing resistance to tearing of the pile yarn woven between the straps to assure that sequential tearing of only the pile ends will occur; and by providing the technique of snubbing or binding the pile yarn in place around each adjacent weft picks of the webbing so that the pile yarn will tear and discourage slipping that may otherwise cause failure of the straps.

6 Claims, 2 Drawing Figures

ENERGY ABSORBING TEAR-WEBBING

BACKGROUND OF THE INVENTION

This invention relates to energy-absorbing tear webbing, and more particularly to such webbing which has woven pile or tear yarn which is designed primarily for parachute harnesses and the like, but it is understood that the invention can be used for any purposes for which it is found applicable.

The use of strap webbing for absorbing shock has been proposed in the parachute art and wherever straps are employed in an environment to absorb shock, such as a window-washer harnesses.

One example of a parachute harness is illustrated in U.S. Pat. No. 2,352,036 where the several straps are temporarily attached together by thread stitching. When a force is applied between the straps, the stitching therebetween is gradually parted to absorb the shock. The intervals between the rows of stitches can be irregular to vary the shock-absorbing characteristics.

Experience has revealed that the backing straps may be physically damaged by the needle during the stitching process, and for this and other reasons it has been proposed to replace the breakable stitching with a pile yarn which is woven in and between the backing straps during the weaving process of fabricating the straps. Such a technique is illustrated by the U.S. Pat. Nos. 3,463,202 and 3,612,110. In these two patents, the pile or binder yarn passes over a group of several weft picks in one strap before transferring to the other strap, etc., except where provision is made for a buckle where the pile yarn extends unwoven along the straps for a predetermined distance.

Test have shown that such prior art webbing straps perform satisfactorily at low speeds, i.e., under 200 f.p.s. However, tearing out through the backing strap is minimized by making the straps much stronger than would otherwise be necessary. Failure of the straps to peel apart at high speeds has prevented the use of such straps in those applications where velocity of separation exceed 300 f.p.s.

SUMMARY OF THE INVENTION

An improved energy absorbing webbing of the type formed of at least two woven straps or tapes interconnected by a woven pile yarn is achieved by uniquely arranging disposition of the pile ends so as to gradually increase the resistance to tearing. In other words, there is a gradual increase in the density of the pile ends along a given length of the webbing which causes a correspondingly gradual increase in shock absorption. A second aspect of the improved webbing is the increased resistance of the straps to tearing out instead of peeling, which result is attained by employing a so called W-shaped weave to snub the pile yarn around each and every weft end, rather than by gross overdesign of the straps as is found necessary in prior-art webbings.

OBJECTS OF THE INVENTION

A principal object of this invention is to provide an energy absorbing tear webbing which will function at high speed separations to achieve the desired result.

A further principal object of this invention is to provide an energy absorbing tear webbing which will provide a gradual and progressively increase in the resistance by the tear elements in such webbing.

Another important object is to provide webbing straps having an increased resistance to tearing out of the backing straps especially to high speed velocities, without the necessity of their being over-strengthened.

A still further object is to provide a webbing having an arrangement of a pile yarn which will snub or bind each and every weft end of the webbing straps.

Still another object is to provide a webbing which is more versatile and which can be tailored for use in a variety of different applications.

Other objects, advantages and novel features of the invention will become apparent from the following detailed description of the invention when considered in conjunction with the accompanying drawings.

DESCRIPTION OF THE PREFERRED EMBODIMENT

Figure 1:
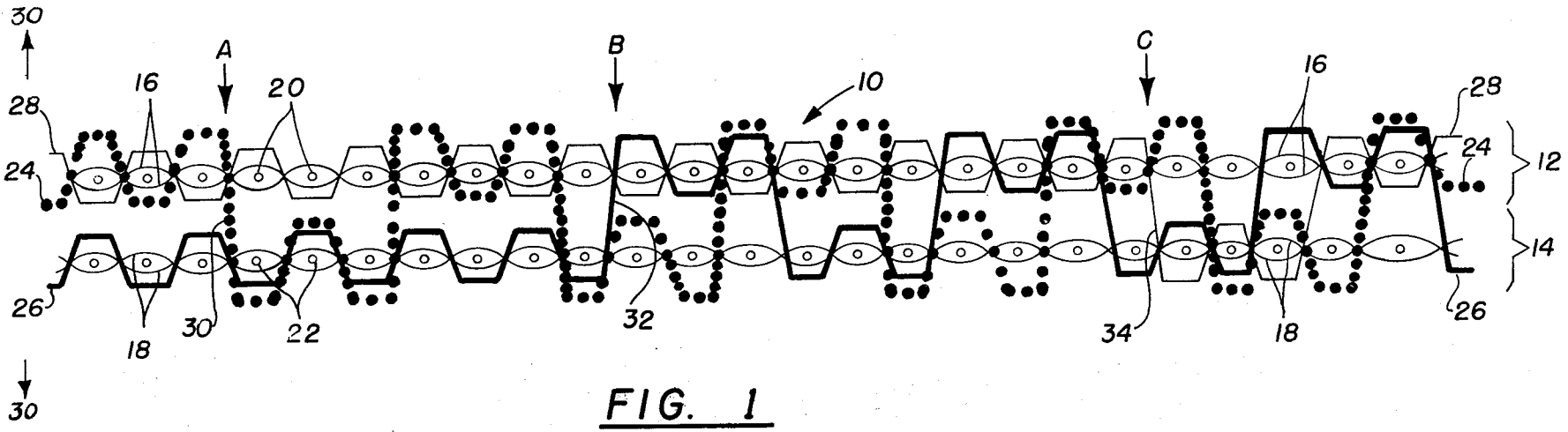
FIG. 1 is a longitudinal sectional view of a sample webbing fabricated from two woven backing straps normally connected together in back-to-back contiguous relation by three pile yarn woven in and between the straps. The straps being shown in an expanded condition for purposes of clarity.

Referring to the drawings where like reference numerals refer to similar parts throughout the figures there is shown in FIG. 1 a sample tear webbing 10 constructed according to the teaching of the present invention. Webbing 10 is fabricated of two woven webbing straps 12 and 14 which straps may be of conventional design and identical to each other. Straps 12 and 14 are woven as separate systems with longitudinally extending warp yarn sets 16, 18, respectively, and transversely extending filler or weft yarn sets 20, 22, respectively. Straps 12 and 14 are woven preferably by separate shuttles to provide independent straps, connected together in the unique manner presently to be described.

Straps 12 and 14 are detachably connected together in contiguous, face-to-face relation, as shown in FIG. 1 by pile yarns 24, 26, and 28, only three pile yarns being shown for clarity of illustration. For example, in FIG. 2 fifteen different pile yarns are illustrated, the details of which will be hereinafter described. Accordingly, the precise manner, as well as the disposition of the pile yarns, used in any particular piece of webbing will depend on the desired amount of energy to be absorbed, which in turn depend on specific application to which the webbing is to be employed.

As is well known in the webbing art, the function of the pile or tear yarn is to absorb energy by tearing when the two straps are pulled apart laterally, for example by the force illustrated by arrows 30. The details of how webbing 10 is incorporated in any specific parachute harness or other equipment and the manner of applying the force 30 forms no part of the present invention.

One of the significant novel features of the present invention is the unique arrangement of detachably connecting the two webbings together to provide for better shock absorption characteristics.

According to the teaching of the aforementioned prior art patent, i.e., U.S. Pat. No. 3,612,110, the pile yarn is woven between the straps uniformly along the length of the webbing, or in other words, the pile yarn woven in a non-graduated or uniform manner. As has been described, this prior art construction generally has been satisfactory when used in low speed separations by constructing the webbing straps stronger than would otherwise be necessary to prevent the tearing-out of the webbing straps.

According to the present invention, the various pile yarns are introduced as pile ends between the webbing straps in a non-uniform or in a graduated manner. Gradually increasing the density of the pile ends along the given length of the webbing, correspondingly will increase gradually the resistance by the pile ends to, and absorption of, the tearing force in any selected increment that is determined by the designer to be optimum for the specific application.

For example, in FIG. 1 pile yarn 24 illustrated by the dotted line, one of the three illustrated pile yarns, initially is woven in webbing strap 12 (progressing from left to right in the drawing) like any warp yarn. Pile yarn 24 progresses along webbing strap 12 and initially becomes a pile end at station A along the length of the webbing at cross-over point 30, between the webbing straps. Thereafter, pile yarn 24 follows a repeated *W* woven pattern alternately in the two webbing straps. The significance of the *W* pattern will be hereinafter described.

The second pile yarn 26, illustrated by the heavy solid line, is continuously woven in webbing strap 14 like any warp yarn, and initially becomes a pile end at station B at cross-over point 32. Thus, at station B pile yarn 26 supplements pile yarn 24, and the two yarns provide an increased resistance to the tearing force 30.

Likewise, third pile yarn 28, illustrated in FIG. 1 by a light solid line, is continuously woven in strap 12 as a warp yarn until station C where it initially becomes a pile end at cross-over point 34. Pile yarn 28 is then woven in a *W* formation in strap 14, and then alternates with a similar pattern between the webbing straps 12 and 14, in a similar manner described for pile yarns 24 and 26.

It should be noted that after station C, webbing 10 thereafter contains a uniform or non-graduated number of pile ends, for the three pile yarn example of webbing shown in FIG. 1. That is, the pile ends of the three different pile yarns consecutively cross over from one webbing strap to the other.

Thus, it can be seen with the three-pile yarn webbing as illustrated in FIG. 1, that the portion of the webbing commencing from the left, as viewed in the drawing, and extending to and including station C represents a graduated pile end webbing section which provides a gradually increasing resistance to the tearing force 30. Conversely, the remaining length of the webbing to the right of station C is a non-graduated pile end webbing section providing a uniform resistance to the tearing force.

Webbing 10 can be woven with only graduated pile ends, namely stations A, B and C or integrated together as shown in FIG. 1, depending on the design requirements.

Figure 2:
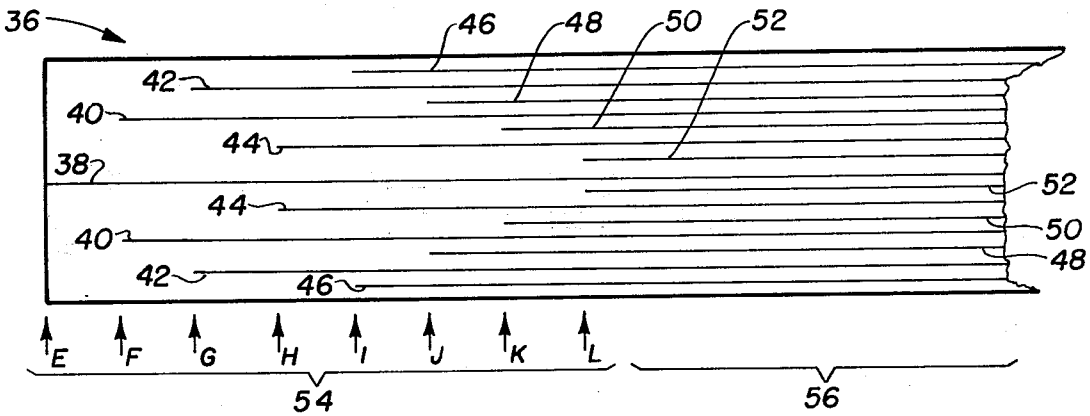
FIG. 2 is a reduced sized diagrammatic top view of the type of webbing in FIG. 1 showing by solid lines the location along the length of the webbing where plurality of pile yarns are gradually first introduced in the webbing as pile ends.

FIG. 2 is a reduced top view of a webbing 36 of the type illustrated in FIG. 1 showing diagrammatically where along the length of the webbing a plurality of the different pile yarns are initially introduced as pile ends in the webbing. For example, a central pile yarn 38 is initially crossed over between the webbing straps at station E at the beginning of the length of the webbing. Similarly, pile yarns 40 to 52, initially appear in the webbing as pile ends at stations F to G, respectively. Therefore, the gradually increasing number of density of pile ends, appearing in non-uniform section 54, as previously described. provides a correspondingly increasing resistance to the tearing force to which the webbing straps are subjected. The section 56 of the webbing 36 in FIG. 2 represents a uniform or non-graduation portion of the webbing which will offer a uniform resistance to the force.

In order to make the increase of resistance in such small steps as to be essentially continuous, the pile yarn can be fed from a creel of individual spools rather than from warps as presently done. The initial resistance to separation can be performed by a small number of pile ends (as few as one to five) and the remaining pile ends can be woven into the backing straps as additional warp ends. By means of a Jacquard machine, one or two additional ends can be added to the pile at intervals, which will, either linearly or logarithmically, depending on the tear webbing length available, include all available ends in the pile at one-half to three-quarters of the available tear length.

This unique so-called W weave configuration of the pile yarns woven in the respective webbing straps is another important feature of this invention. The W pattern should be readily discernible to the eye in FIG. 1. The function of the W weave is to bind or snub the respective pile yarns to each and every filler ends 20 and 22, so that the pile ends will tear rather than slip. Slippage causes the pile yarn to reinforce each other which enables a build-up of forces that will either cause failure of the webbing straps or failure of the webbing to peel and separate. As previously stated this is one of the disadvantages of the prior art patents which requires an over-design in the strength of the backing straps.

As shown in FIG. 1, the W weave is formed by passing each of the pile yarns over one filler end and under the next adjacent filler end thereby achieving a snubbing action between the pile yarn and each of the filler ends, binding the pile yarn in place. To achieve this result, each pile yarn must pass over and under at least three adjacent filler yarns in each webbing strap as shown in FIG. 1, before becoming a pile end, thus forming in effect a W weave. However, if additional binding is found necessary in any particular application the extent of the pile yarn weave in each strap can be extended for additional filler picks in multiples of two, that is, five, seven, etc.

Although Jacquard and creel are the preferred machines for weaving, the above weaving can be accomplished substantially by the use of a Dobby loom with multiple harnesses and with the pile yarn fed either from a creel or from multiple warps.

According to the present invention an improved energy-absorbing tear webbing is proposed that eliminates two of the difficulties experienced with prior art webbings, namely, the tearing out through the backing straps which has caused complete webbing system failure; and secondly; the failure of the pile yarn to tear at high speeds which results in a failure of the webbing to provide energy absorption. The invention webbing system is particularly valuable in high-speed separations where the velocity of separations exceed 300 f.p.s. because the prior art systems are incapable of use for these applications.

Obviously many modifications and variations of the present invention are possible in the light of the above teachings. It is therefore to be understood that within the scope of the appended claims the invention may be practiced otherwise than as specifically described.

What is claimed is:

1. In an energy-absorbing tear webbing comprising at least two independent webbing straps each of which are fabricated of a separate system of woven warp yarns and weft yarns, said webbing straps being detachably secured together in a contiguous face-to-face relation by a plurality of pile tear yarns which are woven simultaneously into each strap and between the straps, the improvement residing in each pile tear yarn being alternately woven over a predetermined plurality of adjacent weft yarns in each strap before crossing over to the other strap, the number of the pile tear yarns that cross between the straps gradually increasing from one end of the webbing to another end of the webbing along the length thereof, whereby any force causing a lateral separation of the webbing straps starting from said one end of the webbing will be gradually absorbed in an increasing magnitude as the number of the pile tear yarns to be broken increases toward said another end of the webbing.

2. In an energy-absorbing tear webbing comprising at least two independent webbing straps each of which are fabricated of a separate system of woven warp yarns and weft yarns, said webbing straps being detachably secured together in a contiguous face-to-face relation by a plurality of pile yarns which are interwoven simultaneously into each strap and between the straps;

the improvement residing in the pile tear yarns being woven alternately over and under each of at least three immediately adjacent weft yarns in alternate and successive portions of both webbing straps, said pile tear yarns being snubbed around and bound to each of the weft yarns in each strap portion before crossing to the other strap;

the total number of pile yarns that cross between the webbing straps varying in number along a selected length of the webbing to change the density of the number of pile yarns that are broken in absorbing the tear force separating the webbing straps.

3. The webbing of claim 2 wherein the total number of adjacent weft yarns encompassed by the pile tear yarn in each webbing portion gradually decrease in number along a selected length of the webbing.

4. The webbing of claim 2 wherein the total number of pile tear yarns that cross between the webbing straps are gradually increased along the length of the webbing thereby gradually increasing the resistance of the webbing to the tearing force.

5. The webbing of claim 2 wherein a selected portion of the webbing contains the same number of pile yarns that cross from one strap to the other for a given length thereof.

6. In a method of fabricating an energy-absorbing tear webbing comprising a pair of independent webbing straps each being fabricated by weaving warp yarns and weft yarns and by simultaneously weaving pile tear yarns into each strap and between the two straps for securing the two straps in contiguous face-to-face relation, the improvement residing in the steps of:

successively snubbing the pile yarns in a pattern alternately over and under each adjacent weft yarn of a predetermined number of weft yarns in each webbing strap before passing the pile yarns across to the other webbing strap;

successively repeating the pattern;

and gradually increasing the number of pile tear yarns that cross from one strap to the other strap over a given length of the webbing.

* * * * *